US010900110B2

(12) United States Patent
Graul et al.

(10) Patent No.: US 10,900,110 B2
(45) Date of Patent: Jan. 26, 2021

(54) METHOD FOR THE HOT FORMING OF A STEEL COMPONENT

(71) Applicant: Volkswagen Aktiengesellschaft, Wolfsburg (DE)

(72) Inventors: Matthias Graul, Brome (DE); Haucke-Frederik Hartmann, Herzberg (DE); Jan Lass, Wolfsburg (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 382 days.

(21) Appl. No.: 15/836,408

(22) Filed: Dec. 8, 2017

(65) Prior Publication Data

US 2018/0100224 A1 Apr. 12, 2018

Related U.S. Application Data

(63) Continuation of application No. PCT/EP2016/058226, filed on Apr. 14, 2016.

(30) Foreign Application Priority Data

Jun. 8, 2015 (DE) ..... 10 2015 210 459

(51) Int. Cl.
*C23C 28/00* (2006.01)
*C23C 2/02* (2006.01)
(Continued)

(52) U.S. Cl.
CPC ..... *C23C 2/02* (2013.01); *C21D 8/0278* (2013.01); *C23C 2/26* (2013.01); *C23C 2/28* (2013.01);
(Continued)

(58) Field of Classification Search
None
See application file for complete search history.

(56) References Cited

U.S. PATENT DOCUMENTS 5,525,431 A * 6/1996 Kanamaru ..... C23C 22/08 148/258
8,066,829 B2 11/2011 Spehner et al.
(Continued)

FOREIGN PATENT DOCUMENTS

DE 10 2005 059 613 A1 6/2007
DE 602 20 706 T2 10/2007
(Continued)

OTHER PUBLICATIONS

Windmann, M., et al., Formation of intermetallic phases in A1-coated hot-stamped 22MnB5 sheets in terms of coating thickness and Si content, Surface & Coatings Technology, Bd. 246, vol. 11, Apr. 2014 pp. 17-25.
(Continued)

*Primary Examiner* — David P Turocy
(74) *Attorney, Agent, or Firm* — Muncy, Geissler, Olds & Lowe, P.C.

(57) ABSTRACT

A method for hot forming a steel component is provided. The steel component is heated into a range of complete or partial austenitization in a heat treatment step. The heated steel component is both hot-formed and quench-hardened in a forming step. A first pretreatment step precedes the heat treatment step in terms of process, in which first pretreatment step the steel component is provided with a corrosion-resistant protective layer in order to protect against scaling in the heat treatment step. Before the heat treatment step is performed, a surface oxidation process occurs in a second pre-treatment step, in which a weakly reactive, corrosion-resistant oxidation layer is formed on the scale protection layer by means of which oxidation layer abrasive tool wear is reduced in the forming step.

16 Claims, 5 Drawing Sheets

(51) Int. Cl.

| | |
|---|---|
| ***C21D 8/02*** | (2006.01) |
| ***C23C 2/28*** | (2006.01) |
| ***C23C 2/26*** | (2006.01) |
| *C21D 8/04* | (2006.01) |
| *C21D 1/673* | (2006.01) |
| *C21D 7/13* | (2006.01) |

(52) U.S. Cl.
CPC ..... *C23C 28/321* (2013.01); *C23C 28/345* (2013.01); *C21D 1/673* (2013.01); *C21D 7/13* (2013.01); *C21D 8/0478* (2013.01)

(56) References Cited

U.S. PATENT DOCUMENTS

| | | | | |
|---|---|---|---|---|
| 2004/0166360 | A1* | 8/2004 | Imai | C23C 28/325 428/658 |
| 2009/0238715 | A1 | 9/2009 | Cho et al. | |
| 2010/0300584 | A1 | 12/2010 | Buschsieweke et al. | |
| 2012/0085466 | A1* | 4/2012 | Lupp | C23C 2/26 148/241 |
| 2012/0118437 | A1* | 5/2012 | Wang | B21D 22/022 148/512 |
| 2016/0222484 | A1 | 8/2016 | Köyer et al. | |

FOREIGN PATENT DOCUMENTS

| | | | |
|---|---|---|---|
| DE | 10 2007 057 855 | B3 | 10/2008 |
| DE | 2012/0085466 | | 8/2010 |
| DE | 10 2010 022 112 | A1 | 11/2011 |
| DE | 10 2008 035 714 | B9 | 5/2013 |
| DE | 10 2014 201 259 | A1 | 7/2015 |
| EP | 1 439 240 | A1 | 7/2004 |
| EP | 2 242 863 | B1 | 1/2014 |
| EP | 2 848 709 | A1 | 3/2015 |
| JP | 2008-223084 | | 9/2008 |

OTHER PUBLICATIONS

International Search Report (English Language Version) dated Jun. 20, 2016.

* cited by examiner

METHOD FOR THE HOT FORMING OF A STEEL COMPONENT

This nonprovisional application is a continuation of International Application No. PCT/EP2016/058226, which was filed on Apr. 14, 2016, and which claims priority to German Patent Application No. 10 2015 210 459.1, which was filed in Germany on Jun. 8, 2015, and which are both herein incorporated by reference.

BACKGROUND OF THE INVENTION

Field of the Invention

The invention relates to a method for hot forming of a steel component and to a steel component.

Description of the Background Art

In vehicle body construction, high-strength or very-high-strength, hot-formed steel components can be used particularly in the area of the passenger compartment, for example, for a B pillar, a tunnel reinforcement, or a side member. In hot forming, a steel plate is heated in a furnace up to the range of complete austenitization (at about 920° C.). The steel plate is placed in a hot state in a forming tool (for example, a deep drawing press) and quench-hardened during compression. In this way, the relatively soft, ferrite-pearlite initial structure of the steel component is transformed into a hard martensite structure with material-dependent strengths in the range of more than 1000 MPa. Boron-alloyed steels with, for example, 0.24% carbon are usually used; in this case, the conversion behavior can be controlled via the alloy (in particular boron) and the achievable strength via the carbon content.

A generic method for hot forming such a steel component is known from EP 2 242 863 B1, which corresponds to U.S. Pat. No. 8,066,829. Before the heat treatment step is carried out in the furnace, the steel component is subjected to a preceding pretreatment step in terms of the process in which step an aluminum-silicon alloy anti-scale layer is formed on the metal surface of the steel component. This is applied to the steel component in a hot-dip process.

During the heat treatment, the furnace temperature is in a range of 900 to 940° C. and the furnace residence time is about 4 to 10 minutes. For this reason, a classic zinc coating cannot be used in the prior art instead of the above-mentioned aluminum-silicon coating. Such a zinc coating would drip off or burn at the above furnace temperatures.

The aluminum-silicon coating acting as an anti-scale layer has the following disadvantages: The aluminum-silicon coating results in a rough, hard surface structure of the steel component, which leads to significant tool wear during press hardening. In addition, there is a highly laminar pronounced layer structure with greatly varying layer properties and an overall only low layer adhesion to the base material, on the order of 20 N/mm$^2$. In addition, the aluminum-silicon coating leads to a high edge corrosion tendency of the steel component and to a reduction of the cap life in resistance welding. Further, the aluminum-silicon coating also negatively affects the quality of the welded joint: Aluminum and silicon do not evaporate during the welding process but solidify in the welding seam, which can lead to weak spots there. In addition, the AlSi coating is prone to chipping or damage during and after hot forming. Due to the absence of a long range effect, a corrosion attack is more likely compared with a zinc coating.

SUMMARY OF THE INVENTION

It is therefore an object of the invention to provide a method for producing a hot-formed steel component, in which the hot forming can be carried out in a simple manner more reliably and efficiently than in the prior art.

The invention is based on the problem that the conventional hot forming process is associated with significant forming tool wear, especially due to the rough, hard metal surface of the steel component. Against this background, after application of the anti-scale layer, a further pretreatment step is carried out in which a surface oxidation takes place. As a result, a weakly reactive, corrosion-resistant oxidation layer, by means of which abrasive tool wear in the downstream forming step can be reduced, is formed on the anti-scale layer.

The surface oxidation can occur simply in terms of process technology, for example, by pickling passivation. For pickling passivation, the steel component is treated in a pickling bath with a pickling solution and then, for example, air-dried at room temperature. The pickling solution by way of example may be the aqueous solution of an acid, in particular phosphoric acid, or a neutral to basic solution.

The roughness of the metal surface of the steel component is reduced by means of the additional oxidation layer, as a result of which the abrasive tool wear is reduced in the forming step. In addition, it is possible to prevent premature wear of any existing component carriers, which transfer the steel component through the heat treatment furnace: In the case of furnace transfer, in the state of the art, diffusion processes take place between the AlSi layer of the steel component and the component carrier (in particular when ceramic rollers are used), which leads to premature failure of the ceramic rollers. Diffusion processes of this kind are significantly reduced by means of the additional oxidation layer of the invention. In addition, the furnace throughput time can be reduced because, according to the invention, the alloying process between the AlSi layer and the base material of the steel component does not have to be fully completed in order to protect the component carrier rollers. Longer permissible furnace throughput times can be tolerated because of better shielding of the substrate.

To further reduce the surface roughness of the steel component, a third pretreatment step may be performed prior to the heat treatment step. In the third pretreatment step, a cover layer with a high melting point can be applied, for example, in a dipping bath. The cover layer is, for example, a titanium-zirconium layer or a metal oxide layer (preferably a titanium oxide layer), which covers the corrosion-resistant oxidation layer. By means of this additional cover layer, melting of the underlying layers, i.e., in particular the anti-scale layer, is prevented in the subsequent heat treatment step. Challenges with the flow behavior can be overcome by suitable alloying of this cover layer.

As mentioned above, in common practice, the anti-scale layer can be an aluminum-silicon layer which is applied to the steel component, for example, in a hot-dip coating process or coil-coating process. Alternatively, the anti-scale layer can also be a zinc or zinc-iron coating, which can be applied to the steel component preferably in a hot-dip coating process. This has a melting point which is less than the heat treatment temperature (about 920° C.) in the heat treatment furnace, as a result of which zinc can melt and flow off the steel component. To avoid this, the zinc or zinc-iron coating is covered with the above-mentioned cover layer of metal oxide or of a titanium-zirconium alloy whose melting points are greater than the heat treatment temperature in the furnace. This prevents melting of the zinc/zinc-iron layer during the heat treatment.

The starting material or substrate of the steel component may be a manganese-boron-alloyed quenched and tempered steel, for example, 20MnB5, 22MnB5, 27MnB5, or 30MnB5. The total layer thickness of the layer structure including the anti-scale layer and the corrosion-resistant oxidation layer and optionally the additional cover layer may be less than 20 μm or greater than 33 μm. The oxidation layer or the cover layer may preferably have a melting point greater than 2000° C., a flexural strength greater than 300 MPa, a compressive strength greater than 2000 MPa, and a Vickers hardness greater than 1600 HV1.

By masking the steel component, a metal surface with locally different surface properties can be adjusted during passage through the pickling passivation (pickling plant). In addition, it is possible to achieve tailor-made properties by targeted free-form coating (that is, oxidation) of the coils or blanks. In addition, the invention improves the weldability and reduces cap wear in resistance spot welded caps. In addition, the energy coupling in laser cutting and welding improves, especially due to a higher degree of absorption of the steel component. The additional corrosion-resistant oxidation layer also forms an effective hydrogen diffusion barrier. In addition, there is an improvement in the possibilities for inline quality assurance by means of thermographic processes by increasing the emissivity (matte surface) and improving the stone chip resistance in the corrosion areas.

In an embodiment, the surface oxidation of the invention in the second pretreatment step can take place over the entire area and on one or both sides of the sheet steel part. Alternatively, the surface oxidation can also occur partially, especially with the formation of at least one surface section without an oxidation layer and a second surface section with an oxidation layer. These surface sections thus have different surface roughnesses, which form different adhesion/friction coefficients with the forming tool surface in contact in the forming step (that is, in the deep-drawing press). In this way, the flow of material can be controlled during hot forming.

Further aspects of the invention and advantages of the invention are described hereinbelow: Thus, the heating of the steel component to a target temperature of at least 945° C. can occur in the heat treatment step, in particular using a heating arrest point in the range of 600° C. The heat treatment may preferably occur in a time interval between about 100 seconds to a maximum of 4000 seconds. For alternative heating routes (induction, conduction), it is possible to deviate significantly downward from these values. The steel component can be a steel sheet having a material thickness in the range of 0.4 to 4 mm, in particular in the range of 0.5 to 2.50 mm. In this case, the oxidation layer of the invention is present at least before, ideally also during and after the furnace run. After the heat treatment, in common practice, a transfer takes place into one or more forming tools or tempering tools for forming or for tempering. In the forming tool, the cooling preferably occurs to a final temperature of below 600° C., in particular to a final temperature of below 400° C.

The total of three pretreatment steps results in a layer system on the steel component of a total of at least five different layers. The oxidation layer in this case effectively prevents contact between the forming tool surface and the underlying layers (that is, for example, the anti-scale layer). By way of example, Al—Fe—Si phases are formed under the oxidation layer of the invention, and an Al—Fe phase forms in particular between these phases and the component base material.

In addition, a thin ferritic layer, which in particular has a layer thickness of less than 100 μm, can form on the outermost layer of the base material (that is, the substrate). The steel component may contain further macroscopically different structures.

Locally different strengths can be achieved in the steel component by applying common process technologies. By way of example, the steel component can be made as a tailored rolled blank, a tailored welded blank, or a patch blank. In addition, the structure may have residual austenite constituents.

The steel components produced according to the invention can be used in different branches of industry, for example, in a vehicle, in particular a land vehicle, a passenger car, or a truck. Use as a safety profile in armored vehicles is possible according to the invention.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
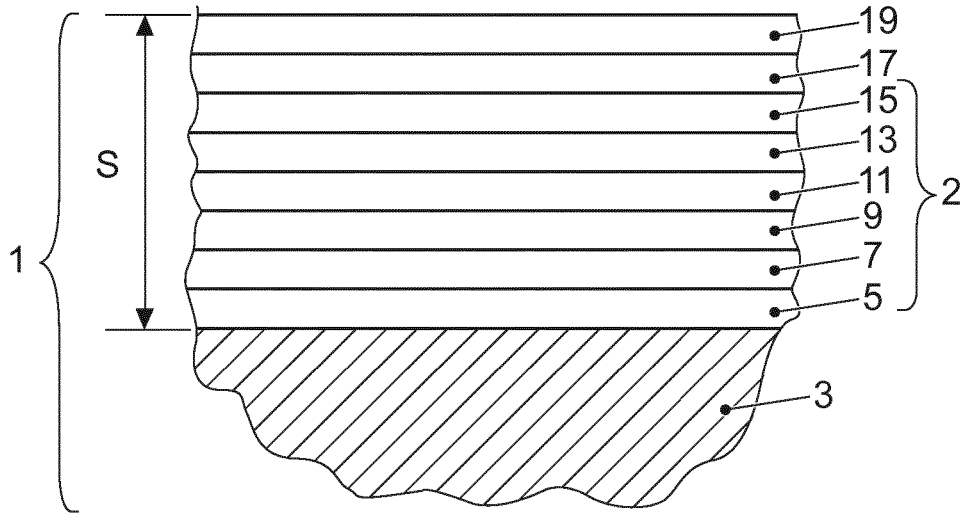
FIG. 1 shows the layer structure on a finished steel component after hot forming.
Figure 2:
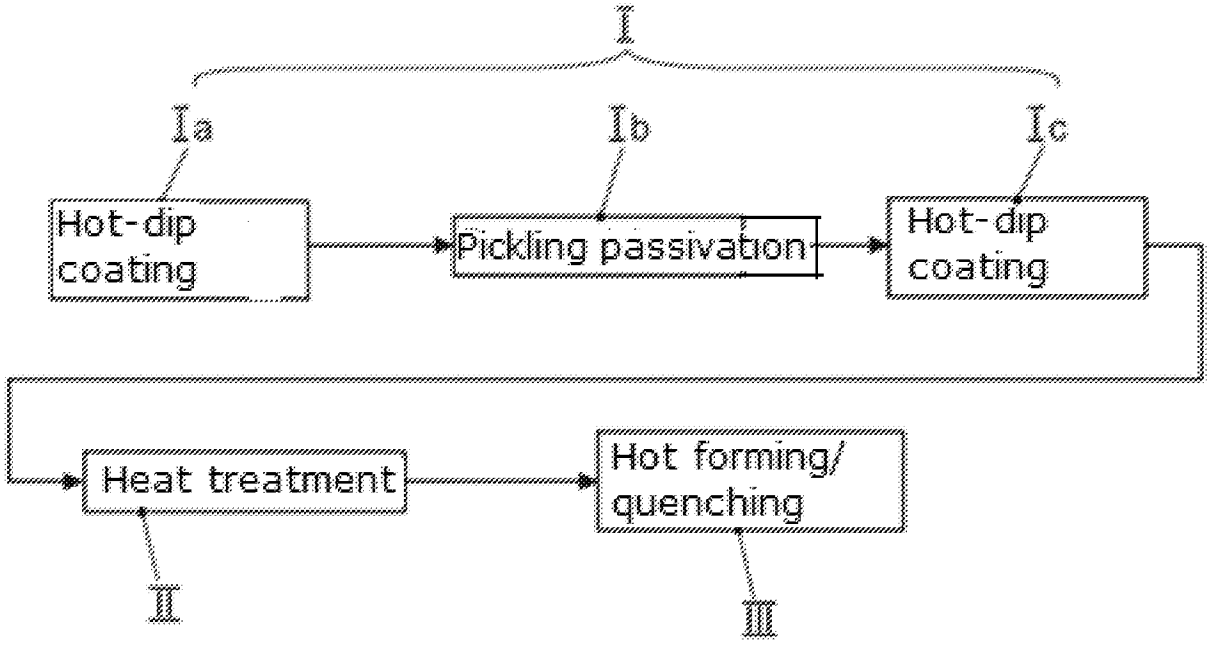
FIG. 2 shows in a simplified block diagram the process steps for producing the steel component shown in FIG. 1.

A coating system of a finished steel component 1, the system being formed by diffusion processes in the furnace, after hot forming is shown by way of example in FIG. 1. The base material (substrate) 3 of steel component 1 is, for example, 22MnB5. A diffusion zone 5, followed outwardly by further alloy layers, namely, an iron-aluminum-silicon zone 7, an iron-aluminum zone 9, an iron-aluminum-silicon-manganese zone 11, an iron-aluminum zone 13, and an aluminum oxide zone 15, an oxidation layer 17, and as a cover layer 19 a titanium oxide layer, is formed directly on base material 3.

The laminar structure labeled by reference number 2 in FIG. 1 corresponds to a coating system as known in the prior art. In addition, the laminar structure is covered with oxidation layer 17 and with cover layer 19. These reduce, inter alia, the roughness of the metal surface of steel component 1, as a result of which the abrasive tool wear in the forming step and in the furnace transfer is reduced.

The method for producing steel component 1 shown in FIG. 1 will be described hereinbelow with reference to FIGS. 2 to 6: Thus, in FIG. 2, base material 3 of steel component 1 is first subjected to a pretreatment I in preparation for the hot forming. Pretreatment I has, inter alia, the process steps Ia, Ib, and Ic shown in FIG. 2. In process step Ia, a hot-dip coating takes place in which aluminum-silicon layer 15 is applied to steel component base material 3. This serves as an anti-scale layer during the heat treatment. In the subsequent process step Ib, a pickling passivation takes place in which steel component 1 is treated with a pickling solution in a pickling bath and then air-dried at room temperature. The pickling solution can be, for example, an aqueous solution of an acid, a base, or pH neutral, for example, phosphoric acid, by means of which the weakly reactive and corrosion-resistant oxidation layer 17 forms on aluminum-silicon layer 15. Next, in a third process step Ic, a further hot-dip coating is carried out in which titanium oxide layer 19 is applied as the cover layer.

Figure 3:
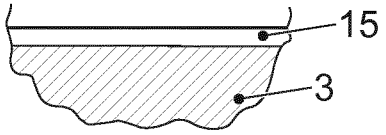
FIGS. 3 to 6 show the layer structure on the surface of the steel component in different process steps.
Figure 4:
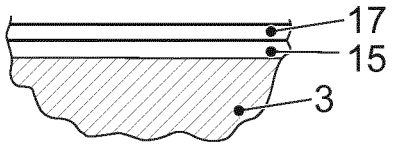
Figure 5:
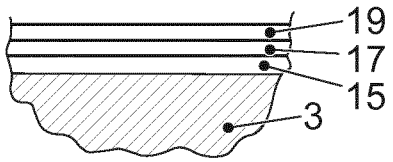
Figure 6:
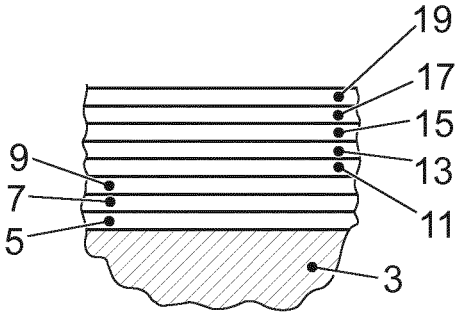

In FIG. 3, steel component 1 is shown after the completed process step Ia, that is, with AlSi layer 15. FIG. 4 shows steel component 1 after process step Ib (that is, after pickling passivation) with the additional oxidation layer 17, whereas steel component 1 after process step Ic, namely, with the additional covering layer 19, is shown in FIG. 5.

Subsequent to pretreatment I, steel component 1 is transferred to a heat treatment furnace in which heat treatment II is performed. For this purpose, steel component 1 is heated to a target temperature of, for example, at least 945° C., by way of example for a predefined process duration which may be in the range of, for example, 100 to a maximum of 4000 seconds. The coating system shown in FIG. 6 forms on the surface of steel component 1 by diffusion processes in the furnace. Steel component 1, which is still in the hot state, is then subjected to a hot forming III, in which steel component 1 is both hot-formed and quench-hardened.

In the above exemplary embodiment, anti-scale layer 15 is an Al—Si layer. Instead, anti-scale layer 15 may also be a zinc or zinc-iron coating. This can be applied to steel component 1 preferably in a hot-dip coating process.

Figure 7:
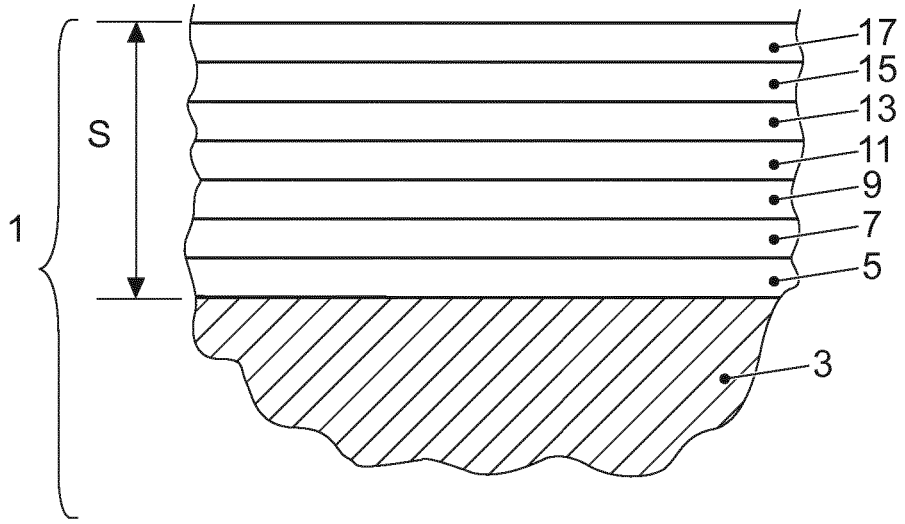
FIG. 7 shows the layer structure on a finished steel component in a view corresponding to FIG. 1.

FIG. 7 shows a steel component 1 according to a second exemplary embodiment, the coating system of which is essentially identical to the coating system shown in FIG. 1. As an alternative to FIG. 1, cover layer 19 has been omitted in FIG. 7, so that oxidation layer 17 is exposed to the outside.

Figure 8:
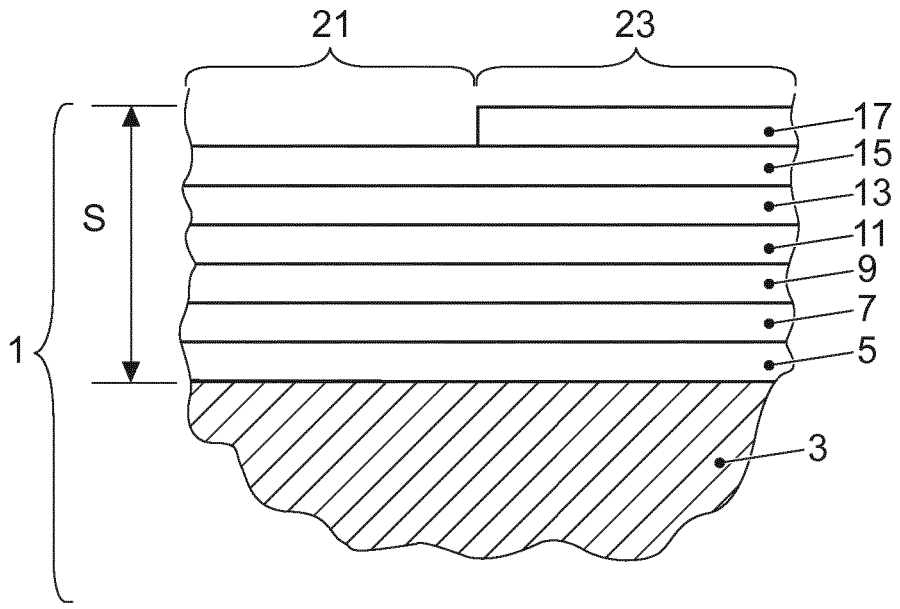
FIG. 8 shows an exemplary embodiment in a view corresponding to FIG. 1.

A further steel component 1 in which oxidation layer 17 is likewise exposed to the outside is shown in FIG. 8. The surface of steel component 1 in FIG. 8 is divided into a surface section 21 without oxidation layer 17 and into a surface section 23 with oxidation layer 17. The two surface sections 21, 23 have different surface roughnesses, which form different adhesion/friction coefficients for the forming tool surface in the following forming step III, as a result of which the flow of material during hot forming can be controlled. Different surface sections 21, 23 of this kind can be adjusted, for example, via a masking of steel component 1 during passage through the pickling passivation (pickling plant).

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method comprising:

heating a steel component into a range of complete or partial austenitization in a heat treatment step;

performing a forming step in which the heated steel component is both hot-formed and quench-hardened;

performing a first pretreatment step that precedes the heat treatment step in terms of process, wherein in the first pretreatment step, the steel component is provided with a corrosion-resistant anti-scale layer to protect against scaling in the heat treatment step; and performing a second pretreatment step before the heat treatment step, wherein a surface oxidation process occurs in the second pretreatment step in which a weakly reactive corrosion-resistant oxidation layer is formed on the anti-scale layer such that abrasive tool wear is reduced in the forming step, wherein the surface oxidation in the second pretreatment step is carried out by pickling passivation, and wherein, for the pickling passivation, the steel component is treated in a pickling bath with a pickling solution and then dried, wherein the pickling solution is an aqueous solution of a phosphoric acid, and wherein the surface oxidation takes place partially in the second pretreatment step with a formation of at least one surface section without the oxidation layer and a surface section with the oxidation layer, and wherein the surface sections have different surface roughnesses which, in the forming step, form different adhesion/friction coefficients with the forming tool surface, as a result of which the flow of material is controllable during the hot forming.

2. The method according to claim 1, wherein a third pretreatment step is performed prior to the heat treatment step, wherein in the third pretreatment step, a cover layer of a high melting point is formed in a dipping bath on the corrosion-resistant oxidation layer, and wherein melting of underlying layers in the subsequent heat treatment step is prevented via the cover layer.

3. The method according to claim 2, wherein the cover layer is a metal oxide layer, a titanium oxide layer, or a titanium-zirconium layer.

4. The method according to claim 2, wherein the oxidation layer and/or the cover layer have a melting point greater than 2000° C., a flexural strength greater than 300 MPa, a compressive strength greater than 2000 MPa, and a Vickers hardness greater than 1600 HV1.

5. The method according to claim 2, wherein the anti-scale layer, the oxidation layer, and the cover layer are applied to a substrate of the steel component before the heat treatment step, and wherein during the heat treatment step, further phases or layers including an Al—Fe—Si phase, an Al—Fe zone, an Al—Fe—Si—Mn Zone, an Fe—Al zone, and an aluminum oxide zone form by diffusion processes under the oxidation layer.

6. The method according to claim 2, wherein the cover layer is a titanium oxide layer or a titanium-zirconium layer.

7. The method according to claim 1, wherein the anti-scale layer is an aluminum-silicon layer, which is applied to the steel component in the first pretreatment step using a hot-dip coating process or a coil-coating process.

8. The method according to claim 1, wherein the anti-scale layer is an aluminum based layer, which is applied to the steel component in the first pretreatment step using a hot-dip coating process or a coil-coating process.

9. The method according to claim 1, wherein the anti-scale layer is a zinc or zinc-iron coating, which is applied to the steel component in the first pretreatment step using a hot-dip coating process.

10. The method according to claim 1, wherein the starting material or substrate of the steel component is a manganese-boron-alloyed quenched and tempered steel.

11. The method according to claim 1, wherein a total layer thickness before the heat treatment step is less than 20 μm or greater than 33 μm.

12. The method according to claim 1, wherein an austenitization temperature of the steel component is not achieved.

13. The method according to claim 1, wherein an austenitization temperature of the steel component is only partially achieved.

14. The method according to claim 1, wherein a critical cooling rate for forming a martensite structure of the steel component is not achieved or is only partially achieved.

15. The method according to claim 1, wherein the starting material or substrate of the steel component is 20MnB5, 22MnB5, 27MnB5 or 30MnB5.

16. A method comprising:

heating a steel component into a range of complete or partial austenitization in a heat treatment step;

performing a forming step in which the heated steel component is both hot-formed and quench-hardened;

performing a first pretreatment step that precedes the heat treatment step in terms of process, wherein in the first pretreatment step, the steel component is provided with a corrosion-resistant anti-scale layer to protect against scaling in the heat treatment step; and performing a second pretreatment step before the heat treatment step, wherein a surface oxidation process occurs in the second pretreatment step in which a weakly reactive corrosion-resistant oxidation layer is formed on the anti-scale layer such that abrasive tool wear is reduced in the forming step, wherein the surface oxidation takes place partially in the second pretreatment step with a formation of at least one surface section without the oxidation layer and a surface section with the oxidation layer, and wherein the surface sections have different surface roughnesses which, in the forming step, form different adhesion/friction coefficients with the forming tool surface, as a result of which the flow of material is controllable during the hot forming.

* * * * *